United States Patent [19]

Lambert, Sr.

[11] Patent Number: 4,869,494

[45] Date of Patent: Sep. 26, 1989

[54] EXERCISE APPARATUS FOR THE HANDICAPPED

[76] Inventor: Theodore E. Lambert, Sr., P.O. Box 564, Morrisville, Vt. 05661

[21] Appl. No.: 327,166

[22] Filed: Mar. 22, 1989

[51] Int. Cl.[4] ..... A63B 21/00; A61H 1/02

[52] U.S. Cl. ..... 272/73; 272/72; 128/25 R

[58] Field of Search ..... 272/73, 72, 900, 144; 128/25 R, 25 B; 280/304.1; 297/DIG. 4

[56] References Cited

U.S. PATENT DOCUMENTS 4,118,046 10/1978 Vaughan ..... 280/304.1
4,402,502 9/1983 Peters ..... 272/73
4,509,742 4/1985 Cones ..... 272/130
4,768,497 9/1988 Winge ..... 128/25 R
4,773,399 9/1988 Richardson ..... 128/25 R

*Primary Examiner*—Stephen R. Crow
*Attorney, Agent, or Firm*—Thomas N. Neiman

[57] ABSTRACT

The exercise apparatus, in the embodiment shown, is adapted for replaceable attachment to the wheelchair of a handicapped user. It encompasses a support frame, gear motors and rotating discs with connecting rods that cause the wheelchair and the apparatus's handles and foot supports to move back and forth. This action enables a user, who is unable to move on his or her own, to experience a range of motion that provides exercise for the muscles in the torso and the extremities.

7 Claims, 1 Drawing Sheet

EXERCISE APPARATUS FOR THE HANDICAPPED

This invention pertains to exercise apparatus and, in particular, to an exercise apparatus for the handicapped that can be used for those who are confined to a wheelchair and who are unable to move their arms, legs, or torso on their own.

BACKGROUND OF THE INVENTION

A large number of the population are handicapped and, in particular, are confined to wheelchairs and the like. For those people, good cardiovascular and muscular exercise is limited. Exerice helps to counteract the effects of long term immobilization or neuromuscular dysfunction resulting from diseases or injuries, such as arthritis, chronic back pain, stroke, neurological diseases, multiple sclerosis, muscular dystrophy, and diabetes. A number of attempts have been made to deal with this problem. The U.S. Patent issued to Amos Yount et al, No. 3,759,512 on Sept. 18, 1973 for an Exercise Machine and the Patent issued to Gilbert Peters, No. 4,402,502 on Sept. 6, 1983 for an Exerciser for Disabled Persons are examples of these attempts. The Yount machine is designed to provide arm and leg exercise to those who are able to sit in the device's chair, however the only exercise provided is rotary exercise. This does not provide exercise for those in wheelchairs unless they are assisted by someone else to be placed in the device's seat. The Peter's exerciser is designed for individuals in wheelchairs, but is limited only to arm leg movements, and does not provide any relatively automatic movement for the torso of the individual.

Clearly, it is desirable for an exercise apparatus for the handicapped to be simple and easy to use and to provide exercise for the arms, legs and torso of individuals confined to a wheelchair. It is the object of this invention, then, to set forth an exercise apparatus for the handicapped which avoids the disadvantages, limitations above-recited, which obtain from prior exercise systems. It is another object of this invention to teach apparatus that can easily be operated by the individual in the wheelchair by themselves.

SUMMARY OF THE INVENTION

Also, it is the object of this invention to teach an exercise apparatus for the handicapped, for replaceable attachment to a wheelchair, comprising a support frame; said frame having drive means attached; said drive means comprises means defining a gear driven motor; said gear means having a disc rotatably mounted; means defining a plurality of connection rods being individually attached at one end to said rotatably mounted disc at distinct positions on said disc; means defining rocker arms; said arm means comprise a plurality of vertically adjustable posts being connected separately to each of said connection rod means at the end opposite said rotatably mounted disc; said arm means having adjustable handle means at the top end of said posts; said arm means further having adjustable foot support means at the bottom end of said posts; wheelchair motion drive means; said wheelchair motion drive means comprises a small gear motor; said small gear motor having a disc means; a frame support post; said frame support post having said small gear motor attached; said small gear motor having wheelchair motion transfer linkage means attached at an offset position; speed control means; and manual power override means.

BRIEF DESCRIPTION OF THE DRAWINGS

Further objects of this invention, as well as the novel features thereof, will become more apparent by reference to the following description taken in conjunction with the accompanying figures, in which.

DESCRIPTION OF THE PREFERRED EMBODIMENT

Figure 1:
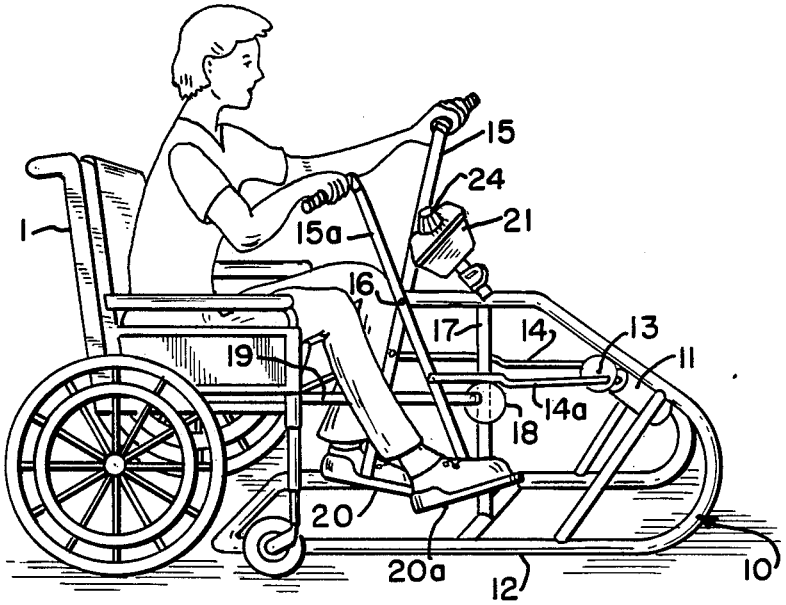
FIG. 1 is a side elevational view of the novel exercise apparatus for the handicapped.
Figure 2:
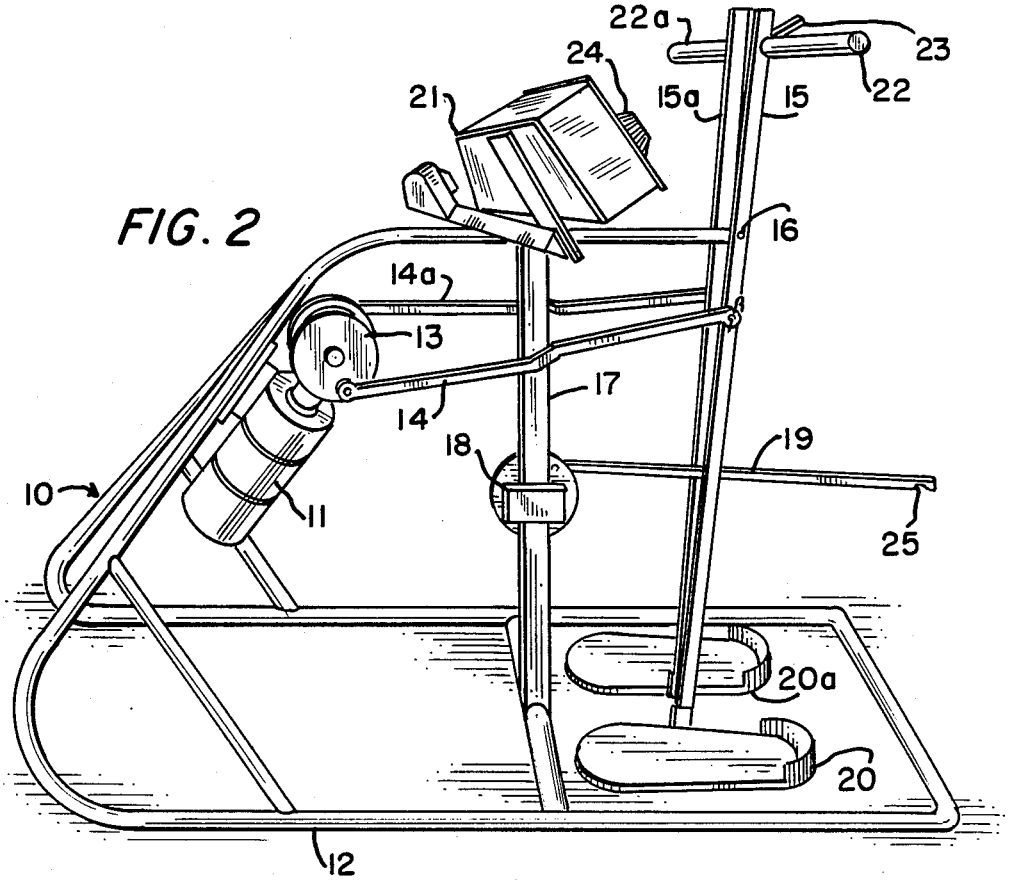
FIG. 2 is a perspective view of the apparatus in operation with a wheelchair connected.

As shown in the figures, the apparatus 10 is powered by a gear motor 11 that is attached to a support frame 12. At one end of the gear 11 is a rotating actuating disc 13 that drives two connection rods 14 and **14*a* that are attached at different positions on opposite sides of the disc 13. The connection rods 14 and 14*a* are each attached to individual rocker arms 15 and 15*a*. The user's legs rest on supports 20 and 20*a* mounted on the rocker arms 15 and 15*a*. At the same time, the user's hands rest on supports 22 and 22*a*. The rocker arms work together to move the arms and legs in a parallel, reciprocating mode (FIG. 1). In this parallel mode, both arms move forward as both legs move back. Note that locking the rocker arms together requires that one of the connection rods 14 and 14*a* be disconnected from one of the rocker arms. By unlocking the rocker arms and using both connection rods, an alternating reciprocating motion is achieved (FIG. 2). A small gear motor 18 located on a vertical frame support shaft 17 has a wheelchair connection shaft 19 attached to a disc on the gear motor 18. The gear motor provides a slow rotation to the disc (approximately one revolution per minute). A shaft 19 is connected at an offset location on the disc. The shaft 19 has indentations 25 which fit over the wheelchair and the shaft moves the wheelchair slowly, in a linear track as the arms and legs are exercised, thus the position of the body relative to the exercise apparatus is continually varied. The motion of the chair is slower that of the moving arms and legs and, therefor, the lengths of the exercised muscles are constantly changing during the course of several cycles. By adding the motion of the wheelchair into the system, problems of severe muscle fatigue and cramping are reduced or eliminated. The apparatus 10 also has a speed control unit 21 that has a dial controller 24 to control the speed of the motion. The unit contains a time measuring system with a forward/reverse switch and also contains an on-off switch. The apparatus also provides an automatic "kill" switch (lever) 23 located on the handle 22 that requires the user to depress the lever for the apparatus to operate and will cut off power to the gear motor 11** when the lever is released. This allows the individual in the wheelchair to control the entire operation of the exercise apparatus.

The exerciser provides a continuous passive/resistive motion of the legs, arms and torso, and has a variable rate of speed adjustment to meet differing levels of ability. The apparatus constantly varies the position of the limbs to alleviate muscle fatigue and involuntary muscle cramping, so that the user can exercise longer without fatigue. The user rolls the wheelchair into position in front of the apparatus and the shaft is connected to the wheelchair. The user's feet are placed in the foot rests. The predetermined speed is selected and the individual's hands are positioned upon the handles and kill switch and then the apparatus is turned on. Passive exercise is achieved by the movement of the rocker arms and the wheelchair. Active exercise can be achieved by using muscle resistance to the rocker arms motion.

While I have described my invention in connection with a specific embodiment thereof, it is to be clearly understood that this is done clearly by way of example and not as a limitation to the scope of my invention as set forth in the objects thereof and in the appended claims.

I claim:

1. An exercise apparatus for the handicapped, for replaceable attachment to a wheelchair, comprising:
- a support frame;
- said frame having drive means attached;
- said drive means comprises a gear means and a driven motor;
- said gear means having a disc rotatably mounted;
- a plurality of connection rod means being individually attached at one end to said rotatably mounted disc at distinct positions on said disc;
- rocker arm means;
- said arm means comprise a plurality of vertical posts being connected separately to each of said connection rod means at the end opposite said rotatably mounted disc;
- said arm means having adjustable handle means at the top end of said posts;
- said arm means further having adjustable foot support means at the bottom end of said posts;
- wheelchair motion drive means;
- said wheelchair motion drive means comprises a small gear motor;
- said small gear motor having disc means;
- a frame support post;
- said frame support post having said small gear motor attached;
- said small gear motor having wheelchair motion transfer linkage means comprising shaft means attached at one end to said wheelchair and at the other end at an offset position on said disk means;
- speed control means; and
- manual power override means whereby the drive means provides user limb exercise and the motion drive means provides motion to the wheelchair.

2. An exercise apparatus for the handicapped, according to claim 1, wherein:
- said distinct position connection of said rod means on said disc comprises means for providing alternating horizontal motion for said rod means.

3. An exercise apparatus for the handicapped, according to claim 1, wherein:
- said arm means are mounted to said frame for pivotal movement at an axis point; and
- each of said arm means comprise means for separate rotation about said axis point.

4. An exercise apparatus for the handicapped, according to claim 1, wherein:
- said small gear motor comprises a low revolutions per minute motor of about one revolution per minute.

5. An exercise apparatus for the handicapped, according to claim 1, wherein:
- said shaft means having indentation means for attaching said shaft means to said wheelchair.

6. An exercise apparatus for the handicapped, according to claim 1, wherein:
- said speed control means comprises a presetable sequential dial control switch;
- said speed control means further having a time measuring system; and
- said speed control means further having an on and off and reverse and forward switch.

7. An exercise apparatus for the handicapped, according to claim 1, wherein:
- said manual power override means comprises a lever on said handle means for removing power from said motor driven gear when said lever is released.

* * * * *